US011333338B2

(12) United States Patent
Grave et al.

(10) Patent No.: US 11,333,338 B2
(45) Date of Patent: May 17, 2022

(54) LIGHTING DEVICE

(71) Applicant: LUMILEDS HOLDING B.V., Schiphol (NL)

(72) Inventors: Manuel Grave, Aachen (DE); Christian Kleijnen, Ell (NL); Udo Karbowski, Aachen (DE)

(73) Assignee: LUMILEDS LLC, San Jose, CA (US)

( * ) Notice: Subject to any disclaimer, the term of this patent is extended or adjusted under 35 U.S.C. 154(b) by 0 days.

(21) Appl. No.: 16/919,871

(22) Filed: Jul. 2, 2020

(65) Prior Publication Data

US 2021/0003275 A1 Jan. 7, 2021

(30) Foreign Application Priority Data

Jul. 4, 2019 (EP) ..... 19184331

(51) Int. Cl.

| | |
|---|---|
| ***F21V 23/00*** | (2015.01) |
| ***F21V 23/06*** | (2006.01) |
| ***H05B 45/46*** | (2020.01) |
| ***H05B 47/155*** | (2020.01) |
| ***F21S 4/24*** | (2016.01) |

(52) U.S. Cl.

CPC ..... *F21V 23/006* (2013.01); *F21S 4/24* (2016.01); *F21V 23/06* (2013.01); *H05B 45/46* (2020.01); *H05B 47/155* (2020.01)

(58) Field of Classification Search

CPC ..... F21V 23/006; F21V 23/06; F21S 4/24; H05B 45/46; H05B 47/155; H05B 33/08; H05B 45/48

See application file for complete search history.

(56) References Cited

U.S. PATENT DOCUMENTS

| | | | | |
|---|---|---|---|---|
| 10,378,747 | B1 * | 8/2019 | Hanslip | F21V 23/06 |
| 2010/0008090 | A1 * | 1/2010 | Li | F21S 4/24 362/249.03 |
| 2011/0050109 | A1 | 3/2011 | Yang | |
| 2011/0068696 | A1 | 3/2011 | Van de Ven et al. | |
| 2013/0249417 | A1 | 9/2013 | Verlinden et al. | |
| 2014/0077709 | A1 | 3/2014 | Zhang et al. | |
| 2014/0334142 | A1 * | 11/2014 | Levante | F21V 23/06 362/222 |
| 2017/0215243 | A1 * | 7/2017 | Briggs | F21V 23/04 |
| 2018/0078072 | A1 | 3/2018 | Loomis | |
| 2020/0256527 | A1 * | 8/2020 | Karbowski | B60Q 3/56 |

FOREIGN PATENT DOCUMENTS

FR 3049810 A1 10/2017

* cited by examiner

*Primary Examiner* — Tracie Y Green
(74) *Attorney, Agent, or Firm* — Volpe Koenig

(57) ABSTRACT

Lighting device, in particular for automotive lighting applications, comprising a plurality of lighting elements arranged in one or more rows in order to form a luminous band, wherein each lighting element comprises at least one or more light emitting diodes (LEDs). The plurality of lighting elements is divided into one or more segments, wherein the lighting elements within each segment are electrically connected in series or in parallel. The lighting device further comprises at least one contacting element providing current for the plurality of lighting elements, wherein at least a first contacting element provides current for a first group of segments such that groups of lighting elements are independently and dynamically controlled.

23 Claims, 10 Drawing Sheets

LIGHTING DEVICE

CROSS REFERENCE TO RELATED APPLICATION(S)

This application claims the benefit of EP Patent Application No. 19184331.7, filed Jul. 4, 2019, which is incorporated by reference as if fully set forth.

FIELD OF INVENTION

The present invention relates to a lighting device, in particular for automotive lighting applications and more particular in the form of a luminous band or lighting ribbon.

BACKGROUND

In the automotive field, it is currently a trend to implement lighting devices which can be controlled dynamically. This means that it is no longer sufficient that the lighting device can be switched on and off, but that in addition parts of the lighting device must be individually adjustable. For instance, in order to generate a dynamic lighting effect, individual parts may be switched on and off or may be dimmed. The availability of light emitting semiconductors (LEDs) has considerably enhanced the development of light emitting device that may be controlled dynamically.

LEDs may be controlled individually by addressing each LED by separate electronic wires. However, this results in numerous wires that need to be connected to a lighting driver in order to control each light emitting diode (LED) individually. This increases the necessary effort to fabricate and implement such a lighting device. Further, due to the numerous wires and the complex wire routing, the spatial constraints of the lighting device, in particular for automotive lighting applications, are easily exceeded.

In order to avoid complex wire routing within the lighting device, it is possible to use flat ribbon cables instead. However, by using such flat ribbon cables, the flexibility of the lighting device is limited since flat ribbon cables are flexible in one direction only and not flexible and bendable in a plane in which the wires of the flat ribbon cable are arranged. Often, modern automotive lighting devices need to follow a complex three-dimensional (3D) shape. Therefore, flat ribbon cables are not suitable for 3D applications.

Alternatively, it is well-known to combine each LED with a control chip such as integrated circuit (IC) or microprocessor, wherein the control chips of the whole lighting device are communicating via a bus wire. However, implementing a control chip for each LED increases the costs of the lighting device. This is in particular true for the automotive field in which each IC or microprocessor must be tested and certified. This decreases the applicability of this solution and prolongs necessary development and design periods. Further, error detection is typically required in the automotive field and needs to be implemented by additional circuitry, which increases the complexity even further.

US 2018/078072 A1 describes a light string with parallel circuits driven respectively by three independent command signals that merge at a common return path. Each of the circuits may have a unique color scheme and/or spatial distribution, for example, to provide for lighting effects. One or more of the lighting elements in any of the circuits may be individually addressable by, for example, serial commands supplied on the corresponding command signals.

US 2011/050109 A1 relates to a reverse polarity series type LED which is formed by two sets of LED and diode assemblies in reverse polarity series connection wherein the first set is consisted of at least one or multiple homopolar series or parallel connected or series and parallel connected LED's, and the second set consisting of at least one or more homopolar parallel or series connected or series and parallel connected LED's for further connection to the drive circuit formed by currentlimiting impedance and/or power storage and discharging devices and/or voltage-limit circuit devices in order to produce the required operational characteristics.

SUMMARY

It is an object of the present invention to provide a lighting device that is flexible, dynamic controllable, less complex and suitable for error detection. The given object is achieved by a lighting device in accordance with claim 1 as well as a lighting device in accordance with claim 17. Further advantageous embodiments to the lighting device of the present invention have been specified in dependent claims.

According to a first aspect of the present invention, there is provided a lighting device, which is particularly suitable for automotive lighting applications, in particular in cars. According to claim 1, a plurality of lighting elements is arranged in a row, wherein each lighting element comprises at least one LED. Consequently, a luminous band or lighting ribbon is formed, which can be placed, for instance, below or between other lighting devices of a car and is convenient for the styling of signalling functions.

In addition, a long and very narrow lighting device may be achieved by arranging a large number of the lighting elements in a row. The lighting device has a length which extends the width of the lighting device. For instance, the length of the lighting device may be more than 200 mm or more than 500 mm, while for instance, the width of the lighting element may be below 10 mm or below 6 mm. The lighting elements are also known as or referred to as interposers. Preferably, the lighting elements are built identically. The lighting elements may comprise a printed circuit board (PCB) carrying the LED. The LED can be mounted to the PCB either by direct attachment of the naked die or can be mounted as a surface mounted device (SMD), as a through hole technology (THT) component or any other type of component. A PCB may comprise one LED or more than one LED.

In accordance with the first aspect of the present invention, the above-mentioned plurality of lighting elements is further divided into a plurality of segments and the lighting elements within each segment are electrically connected in series. In addition, each segment may comprise the same or different number of lighting elements. It is further preferred that the physical connections between the lighting elements within each segment are physically arranged in series as well in order for convenient control and design of patterns of lighting and dimming. Segmentation of the lighting elements enables random resolution of the lighting and dimming of the luminous band depending on the length of each segment compared with that of the luminous band. Further, the complexity of the lighting device can be reduced while still providing a diverse range of lighting functions due to the individually controllable segments of lighting elements.

In accordance with the first aspect of the present invention, a first contacting element is placed at a first end of the above-mentioned row of lighting elements providing current for a first group of segments, wherein the first group of segments comprises at least one segment of lighting elements. The first end may be either of the two ends of the luminous band. Following the luminous band design, electrical connections between the first contacting element and the first group of segments are physically arranged substantially in parallel to or along the row of lighting elements. Therefore, for a certain group of segments, only one contacting element is needed for power supply thus reducing the required number of contacting elements and this contacting element controls the lighting and dimming of this group independently to the other groups.

In addition, a contacting element serves to connect the lighting device to a lighting driver, wherein the contacting element can be built as an integral part of the lighting device or a separate entity. More specifically, the current can be provided via wires directly to the leadframe, for instance, by means of soldering structures comprised in the lighting elements (see, for instance, FIG. 9 showing contacting elements in the form of soldering points); and the current can also be provided through a connector which is preferably an independent entity being separate from the lighting elements (see, for instance, FIG. 1-FIG. 6 showing contacting elements in the form of connectors).

Thus one or more contacting elements serve to control the lighting device and provide the power for the lighting device as well. In order to achieve dynamical lighting, the one or more contacting elements can address individual segments of lighting elements.

Therefore, the present invention has the advantage of independent, flexible and dynamic control of the lighting and dimming of lighting elements with random resolution as well as reduced complexity and space of the luminous band.

In particular, each segment is further divided into at least two sub-segments; and, within each segment, any two consecutive sub-segments are electrically connected anti series to each other, wherein anti series refers to that the two sub-segments are connected in series but with polarities of their respective lighting elements reversed to each other. Therefore, each sub-segment is only switched on during a certain period of the time before the respective current of each sub-segment is reversed; and the current running through the LEDs of each sub-segment is higher than the average current since not all the sub-segments are used at a given moment. The segment-wise resolution of the lighting and dimming is consequently increased; that is, within each segment, it can be flexibly selected which sub-segments are switched on during a given period. Further, the increment in resolution of lighting and dimming can be flexibly controlled by altering the amount of lighting elements in each sub-segment as well as that in each segment.

In particular, each LED is electrically connected anti parallel to at least one rectifier diode, wherein anti parallel refers to that each LED and the respective at least one rectifier diode are connected in parallel but with their polarities reversed to each other. Thus, currents at a given moment on un-used sub-segments are bypassed through the at least one rectifier diode arranged in the un-used sub-segments.

In particular, the first contacting element comprises a plurality of pins which refer to power-supply terminals. The pins are preferably arranged in one column and comprise at least one voltage supplying pin as well as at least one ground pin. The voltage supplying pin provides high voltage or low voltage, wherein high voltage supplying pins are also known as or referred to as anode pins or positive pins and low voltage supplying pins are also known as or referred to as cathode pins or negative pins.

In particular, a second contacting element is arranged preferably at a second end of the row of lighting elements providing current for at least a second group of segments, the second group of segments comprising at least one of the segments other than those in the first group. The second end is preferably different from and opposite of the first end as mentioned above. The second contacting element increases the number of addressable groups without increasing the complexity of the wire routing such that a large number of groups can be individually addressed by at least two contacting elements in order to provide dynamic lighting.

In particular, the electrical connections between the second contacting element and the second group of segments are physically arranged substantially in parallel to or along the row of lighting elements. The physical parallelism between the second contacting element and the second group of segments as well as that between the first contacting element and the first group of segments enhance the operability of independent and dynamic control.

In particular, the second contacting element comprises a plurality of pins, the pins being preferably arranged in one column and the number of pins being preferably the same as the number of pins of the first contacting element. It is possible that the second contacting element only comprises anode pins. Alternatively, it is possible that the second contacting element also comprises one or more anode pins and one ground pin. Alternatively, it is possible that the second contacting element comprises more than one ground pins.

In particular, at least one more contacting element is arranged between the first contacting element and the second contacting element along the row of lighting elements. Each of the at least one more contacting element provides current for one group of segments which is not supplied with power by the first contacting element or the second contacting element. The at least one more contacting element increases the number of addressable groups without increasing the complexity of the wire routing such that even more groups can be individually addressed for dynamic lighting.

In particular, the electrical connections between the at least one more contacting element and the respective group of segments are arranged substantially in parallel to or along the row of lighting elements. The physical parallelism between the contacting elements and their respective groups of segments enhances the operability of independent and dynamic control.

In particular, each contacting element between the first contacting element and the second contacting element comprises a plurality of pins, the pins being preferably arranged in two columns and the number of pins in each column being preferably the same as the number of pins of the first contacting element and/or the second contacting element. It is possible that each contacting element between the first contacting element and the second contacting element comprises one or more anode pins.

In particular, the lighting device in accordance with the present invention comprises 1, 2, or 3 contacting elements. With not more than 3 contacting elements, independent, flexible and dynamic control of the lighting and dimming patterns is possible without resorting to the complex solution provided by the microcontroller or occupying much space in the narrow luminous band.

In particular, the row of lighting elements is run through by a plurality of bendable electrical wires which are arranged substantially in parallel to each other. The electrical connections in the lighting device can thus be routed within the bendable electrical wires. The individual lighting elements are connected by the plurality of electric wires. The direct connection between subsequent lighting elements may as well comprise one or more physical connections, which physical connections serve to connect the lighting elements in the structure of the lighting device. Such physical connections may again be wires, more particularly also one or more of the electric wires may provide the physical connections and thus have a double function. Consequently, the lighting elements are connected by more than one electrical wire and may as well, in addition, be physically connected. If the lighting element is built as circuit board then the wires may be physically connected to the PCB or through the PCB and are in electrical contact with the one or more LEDs of the specific lighting element.

In particular, the bendable electrical wires are flexible in two axes. For instance, bending of the lighting device along horizontal and vertical axes in a certain surface of a car is possible. Versatile ways of styling of the signalling functions can thus fit into the signalling system of a car. Preferably, the wires are arranged in a common plane. Bending of the lighting device perpendicular to this plane is possible in order to adapt the shape of the lighting device to the specific application. Even a complex 3D shape is possible. Preferably the two bendable axes are perpendicular to each other and perpendicular to the longitudinal axis of the lighting device. The longitudinal axis of the lighting device is defined as the axis running along the row or lighting elements. A possible bending radius is preferably below 100 mm, more preferably below 50 mm and most preferably below 25 mm. Additionally or alternatively, the lighting device is twistable around the longitudinal axis. Preferably, twisting of the lighting device of 90° is possible within a length of 100 mm, more preferably within 75 mm and most preferably within 50 mm. With such flexibility the lighting device is suitable for a large number of applications and may be adapted to all kind of shapes.

In particular, the number of bendable electrical wires is the same as the number of pins of the first contacting element and/or the second contacting element and/or a third contacting element if any. Preferably, the arrangement of the wires between each of the lighting elements are identical along the complete row.

In particular, the lighting device in accordance with the present invention comprises 3 or 4 bendable electrical wires. Preferably the number of wires between each of the lighting elements is the same along the complete lighting device. Increasing the number of wires between each of the lighting elements also increases the ability to control more groups of lighting elements. Simultaneously, the complexity of the lighting devices increases as well as the necessary installation space. Thus, with a maximum of 4 wires between each of the lighting elements, a sufficiently large number of groups can be controlled in order to provide dynamic lighting.

In particular, at least two segments consist of the same number of lighting elements. This makes it possible, for instance, for the lighting driver, to compare current and/or voltage of the two segments and to detect an error if there is a deviation of current or power between the two identical segments. Preferably each segment consists of the same number of lighting elements, and even more preferred each segment of lighting elements comprises the same number of LEDs. Thus, current and voltage of each segment can be compared with each other in order to obtain a reliable error detection.

According to a second aspect of the present invention, there is provided a lighting device, which is particularly suitable for automotive lighting applications, in particular in cars. In order for simplicity, similar features which pertain to the present invention as mentioned above regarding the first aspect of the present invention are omitted in the following. According to the present invention, a plurality of lighting elements is arranged in one or more parallel rows, wherein each lighting element comprises at least one LED. Each parallel row as mentioned above may comprise the same or different number of lighting elements. In this case, a luminous band or lighting ribbon comprising one or more rows of lighting sources is formed, which can not only be placed flexibly at positions where space is limited but also allows even more versatile patterns of lighting and dimming required by different signalling functions.

The plurality of lighting elements is divided into a plurality of segments and the lighting elements within each segment are electrically connected in parallel. In addition, each segment as mentioned above may comprise the same or different number of lighting elements; and lighting elements that belong to the same segment are preferably arranged in the same row of lighting elements. It is further preferred that the physical connections between the lighting elements within each segment are physically arranged in parallel as well in order for convenient control and design of patterns of lighting and dimming. Analogous to what is disclosed above, segmentation of the lighting elements enables random resolution of the lighting and dimming of the luminous band depending on the length of each segment compared with that of the luminous band; and the complexity of the lighting device is reduced while still providing a diverse range of lighting functions due to the individually controllable segments of lighting elements. Furthermore, the parallelism as mentioned here, in addition to the serialism as described before, between lighting elements in one segment, provides an alternative solution to the dynamic control mechanism.

In accordance with the present invention, current for the plurality of lighting elements is provided by a first contacting element comprising at least three power-supply pins. The first contacting element is arranged at one end of the one or more parallel rows of lighting elements and electrically connected thereto, wherein electrical connections therebetween are physically arranged substantially in parallel to the one or more rows of lighting elements such that a luminous band is formed. It is thus flexible to assign, from the at least three power-supply pins, two pins as power supply for certain segments of lighting elements such that different segments can be independently controlled by the respective power-supply pins connected thereto. The complexity is also reduced since one contacting element can flexibly control all the segments.

Therefore, analogously to what is discussed before, the present invention has the advantage of independent, flexible and dynamic control of the lighting and dimming of segments of lighting elements with random resolution as well as reduced complexity and space of the luminous band.

Further, while independent and dynamic control of the lighting elements, as discussed above, results from further grouping of segments and then assigning to different contacting elements different groups, the same effect is achieved now by segmentation of lighting elements across one or more rows and assigning the segments to different pairs of pins comprised in only one contacting element.

In particular, across any two power-supply pins, there are at least two segments electrically connected thereto which are connected anti parallel to each other. In other words, the at least two segments are connected in parallel but with polarities of their respective lighting elements reversed to each other. It can thus be flexibly selected, given any two power-supply pins, which segments therein are switched on during a given period. Alternatively, the length of each segment across any two power-supply pins can be extended by adding more lighting elements. Any two consecutive segments across any two power-supply pins may comprise the same number or different number of lighting elements depending on the requirements of the styling functions of the lighting applications. Considering the one or more rows, even more patterns can be achieved. As a result, the resolution, across any two power-supply pins, of lighting and dimming is further increased, as well as patterns of lighting functions formed along the whole luminous band.

Further, as mentioned above, the further increment of resolution as explained before, is achieved by adding a rectifier diode to each lighting element and sub-segmentation of a segment wherein any two consecutive subsegments are electrically connected anti series to each other such that only one sub-segment therein can be switched on at a given moment; whereas the same or similar effect is achieved now by an alternative solution wherein two consecutive segments across two power-supply pins are electrically connected anti parallel to each other such that, given certain values of the pair of pins, only one segment can be switched on.

In particular, the three power-supply pins comprised in the first contacting element are preferably arranged in one column, and values of voltages provided by the three pins are preferably different from each other. This configuration of power-supply pins serves to ensure, between any two power-supply pins, that some segments connected therebetween can be switched on while the other segments also connected therebetween but with reversed polarities cannot be switched on.

In particular, each lighting element is electrically connected to a current limiter in series. Current limiters, as is well known to be in the form of resistors, are used to ensure that there is not enough power to switch on, across any two given power-supply pins, segments whose polarities are reversed to those segments which can be switched on. Given a first power-supply pin, a second power-supply pin and a third power-supply pin with their values of currents in a decreasing order, it is possible that the first segment between the first power-supply pin and the second power-supply pin is connected therebetween with a current limiter connected between the cathode pin of the first segment and the second power-supply pin, and the second segment is connected anti parallel to the first segment as described above with a current limiter connected between the anode pin of the second segment and the second power-supply pin; alternatively or additionally, it is possible that the first segment between the second power-supply pin and the third power-supply pin is connected therebetween with a current limiter connected between the cathode pin of the second segment and the third power-supply pin, and the second segment is connected anti parallel to the first segment as described above with a current limiter connected between the anode pin of the second segment and the third power-supply pin; and alternatively or additionally, it is possible that the first segment between the third power-supply pin and the first power-supply pin is connected therebetween with a current limiter connected between the anode pin of the first segment and the first power-supply pin, and the second segment is connected anti parallel to the first segment as described above with a current limiter connected between the cathode pin of the second segment and the first power-supply pin. It is therefore possible to achieve, across any row of the luminous band as well as any two power-supply pins, flexible and dynamic patterns of lighting and dimming with selected voltages provided by the respective pins connected to the lighting driver. Thus, highly complex patterns or ways of lighting and dimming of different or distant lighting elements are possible with the present invention.

In particular, the lighting driver providing power through the power-supply pins is an active B6 bridge.

In particular and analogous to the first aspect of the present invention, the lighting device further comprises a plurality of bendable electrical wires running through the rows of lighting elements and arranged substantially in parallel to each other.

In particular and analogous to the first aspect of the present invention, the bendable electrical wires are flexible in two axes and/or twistable along a longitudinal axis of the lighting device, wherein preferably the two bendable axes are perpendicular to each other and/or perpendicular to the longitudinal axis.

In particular, the number of bendable electrical wires is preferably 3. Since three power-supply pins are provided, three electrical wires are enough to apply independent control over different rows along the luminous band as well as over different segments across any two power-supply pins, which greatly reduces the complexity and space required by a diverse range of lighting applications as well as ensuring versatile and complex patterns of lighting functions.

In particular, the present invention further comprises one or more of the features described in connection with the first aspect.

BRIEF DESCRIPTION OF THE DRAWINGS

Non-limiting and non-exhaustive embodiments of the present invention as described above are referenced to the following figures, wherein same or similar elements are indicated by identical reference signs.

FIG. 5-1 is a circuit diagram of another embodiment of the present invention;

FIG. 5-2 is a circuit diagram of another embodiment of the present invention.

DETAILED DESCRIPTION OF THE PREFERRED EMBODIMENTS

In the following description, for purposes of explanation rather than limitation, specific details are set forth such as the particular architecture, interfaces, techniques, etc., in order to provide a thorough understanding of the concepts of the present invention. However, it will be apparent to those skilled in the art that the present invention may be practiced in other embodiments, which depart from these specific details. In like manner, the text of this description is directed to the example embodiments as illustrated in the Figures and is not intended to limit the claimed invention beyond the limits expressly included in the claims. For purposes of simplicity and clarity, detailed descriptions of well-known devices, circuits, and methods are omitted so as not to obscure the description of the present invention with unnecessary details. The following description should not be understood to limit the assignment of any specific feature to a specific embodiment. Thus, the features of the embodiments mentioned hereinafter can be freely combined with each other.

Figure 1:
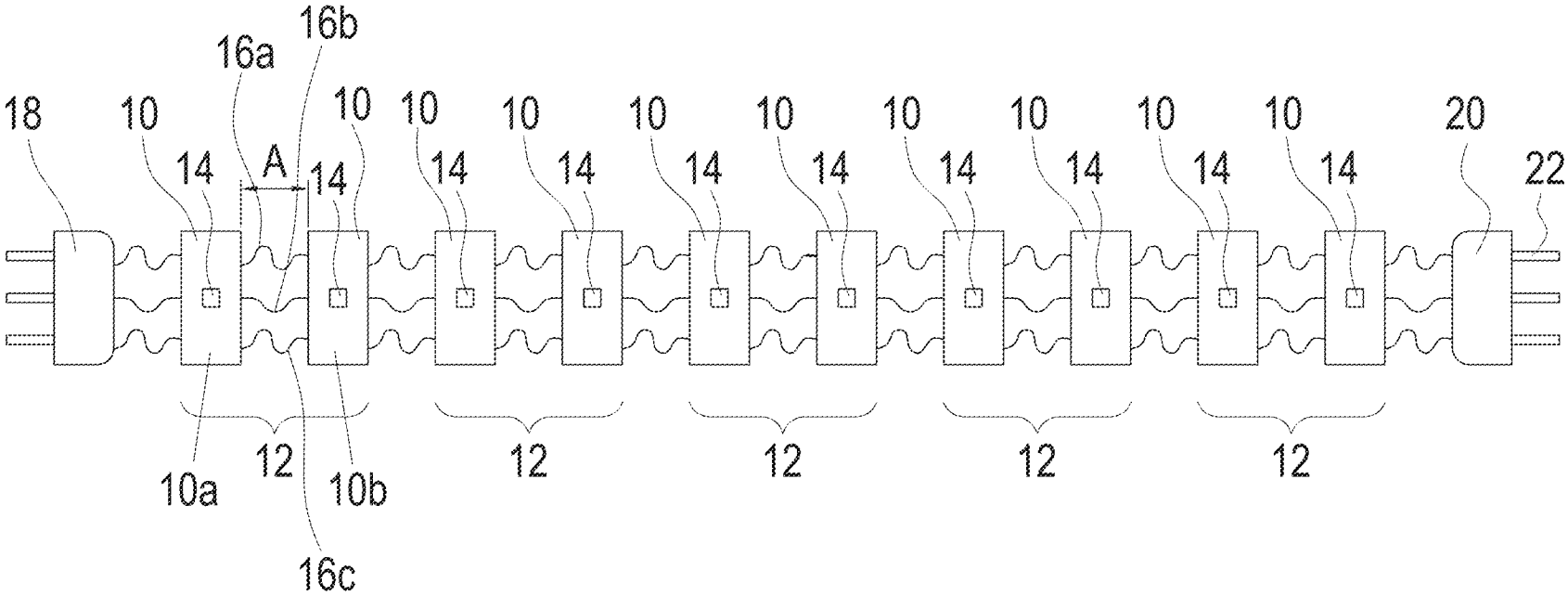
FIG. 1 is a schematic drawing of a lighting device in accordance to the present invention.

FIG. 1 illustrates a realization of the lighting device in accordance to the present invention. The lighting device comprises a plurality of lighting elements 10, wherein in the example of FIG. 1, the lighting device comprises ten lighting elements 10. Therein, the lighting elements 10 are divided into five segments 12, wherein each segment consists of two lighting elements 10. Of course, the lighting device may have less than 10 lighting elements 10 or more than 10 lighting elements 10. Additionally, also each segment may consist of one or more lighting elements 10. Each of the lighting element comprises in the example of FIG. 1 one light emitting diode (LED) 14. Each lighting element 10 may also comprise more than one LED 14. In particular, it is not necessary that each of the lighting elements 10 have the same number of LEDs 14. However, it is preferred that each of the lighting elements 10 have the same number of LEDs 14 and it is further preferred that each of the segments 12 comprise the same number of lighting elements 10 as depicted in FIG. 1. Thus, preferably each segment has the same number of LEDs.

All LEDs 14 are directed in the same direction. Thus, along the complete lighting device light is emitted only in one half space. Therein, the lighting device may emit light only with an opening angle of the emission equal to or below 180° and more preferably equal to or below 120° or equal to or below 90°. In order to enhance the characteristics of emission further, a reflective element can be arranged on a plane parallel to the common plane of LEDs (corresponding to the image plane of FIG. 1), reflecting all light into the desired half space. Further, the width of the lighting device is below 10 mm and preferably below 6 mm. Thus, a very narrow and long luminous band can be built providing a high efficiency of lighting.

The lighting elements 10 are arranged in a row, wherein each lighting element 10 is directly connected to a preceding lighting element and/or a following lighting element 10 by wires 16*a*, 16*b* and 16*c*. Thus, the lighting device of FIG. 1 comprises three wires between each of the lighting elements. In the example of FIG. 1 the number of wires 16 between each of the lighting elements 10 is identical. However, it is also possible to have between at least two or more lighting elements 10 an unequal number of wires. The lighting elements 10 are electrically connected to each other by the wires and the same electrical wires also provide the physical connection of the lighting elements. However, within the scope of the invention the physical connection need not to be the same as the electrical connection. In the embodiment of FIG. 1, a first lighting element 10*a* is directly electrically and physically connected to a second lighting element 10*b* by wires 16*a* to 16*c*.

A first connector or contacting element 18 arranged at a first end, namely the leftmost end, of the row of lighting elements 10 is connected via wires 16*a* to 16*c* to the row of lighting elements 10. Additionally, a second connector 20 is arranged at a second end, namely the rightmost end, of the row of lighting elements 10 and connected to the row of lighting elements 10 also by the wires 16*a* to 16*c*. The first connector and the second connector each comprise three pins 22, wherein the number of pins of the connectors 18, 20 is equal to the number of wires of the lighting device. Thus, by using two connectors 18, 20 and three wires 16*a* to 16*c*, five segments 12 can be individually controlled by a lighting driver (not shown) to which the lighting device of FIG. 1 is connected via the first connector 18 and the second connector 20. Thus, a sufficiently large number of segments can be dynamically controlled while the complexity of wiring each of the individual segment is low using only three wires between each of the lighting elements 10.

As shown in FIG. 1, the distance A between each of the lighting elements 10 is smaller than the length of each of wires 16*a* to 16*c*. In the example of FIG. 1 the distance A between each of the lighting elements 10 is equal. However, it is also possible to have at least two or more distances between respective lighting elements 10 which differ from each other. The wires have a bended or tortuous shape in order to provide an excess length. By this excess length, bending of the lighting device is possible and further thermal expansions of the lighting device can be compensated. Additionally, the outer wires 16*a* and 16*c* comprise a longer length than the inner or central wire 16*b*. Thus, the lighting device can be bended in a plane in which also the wires 16*a* to 16*c* are arranged corresponding to the plane of the image plane of FIG. 1. Therefore, the lighting device can be adapted to any three-dimensional (3D) shape of the application. In particular, due to the specific configuration twisting of the lighting device of 90° is possible within a short length, providing sufficient flexibility to be adapted to all different kinds of applications, i.e. shapes. Further, a bending radius is preferably below 100 mm, more preferably below 50 mm and most preferably below 25 mm.

Figure 2:
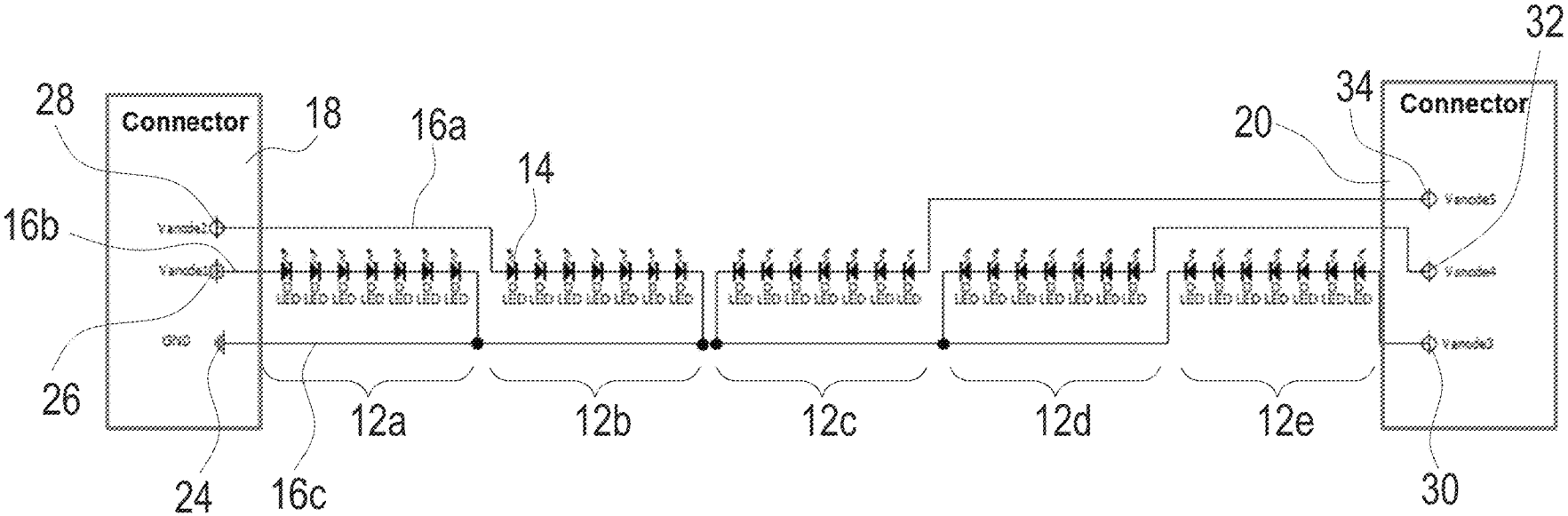
FIG. 2 is a circuit diagram of an embodiment of the present invention.

FIG. 2 shows a circuit diagram of a lighting device comprising five segments 12 in accordance to FIG. 1, wherein each segment 12 comprises in the example of FIG. 2 seven LEDs 14. Therein, each LED 14 can be disposed on an individual lighting element 10 or more than one LED 14 can be disposed on a single lighting element 10 of one segment 12 up to the case that all seven LEDs 14 are disposed on a single lighting element 10. Further, the lighting device of FIG. 2 has a first connector 18 and a second connector 20. Three parallel wires 16*a*, 16*b* and 16*c* stem from the first connector 18 and are arranged in parallel along the entire length of the lighting device connecting also the second connector 20. The LEDs 14 are arranged along a row in order to define a luminous band or lighting ribbon.

The first connector 18 comprises a ground pin 24, as well as a first anode pin 26 and a second anode pin 28. The second connector 20 comprises a third anode pin 30, a fourth anode pin 32 and a fifth anode pin 34. Therein, with the first anode pin 26, a first segment 12*a* of LEDs 14 is controlled, wherein the first segment 12*a* is connected to the ground pin 24 of the first connector 18 as well. With each further anode pin of the first connector 18 or the second connector 20, the segments 12 of LEDs 14 can be directly addressed by the lighting driver connected via the first connector 18 and the second connector 20 to the lighting device. Thus, the first connector 18 controls a first group of segments including 12*a* and 12*b* and the second connector 20 controls a second group of segments including 12*c*, 12*d* and 12*e*. The five segments 12 of LEDs 14 can be individually addressed in order to provide dynamical lighting, which is achieved only by using three parallel wires along the entire length of the lighting device, thereby maintaining the ability to bend the lighting device in all directions and providing a low complexity of wire routing within the lighting device.

Figure 3:
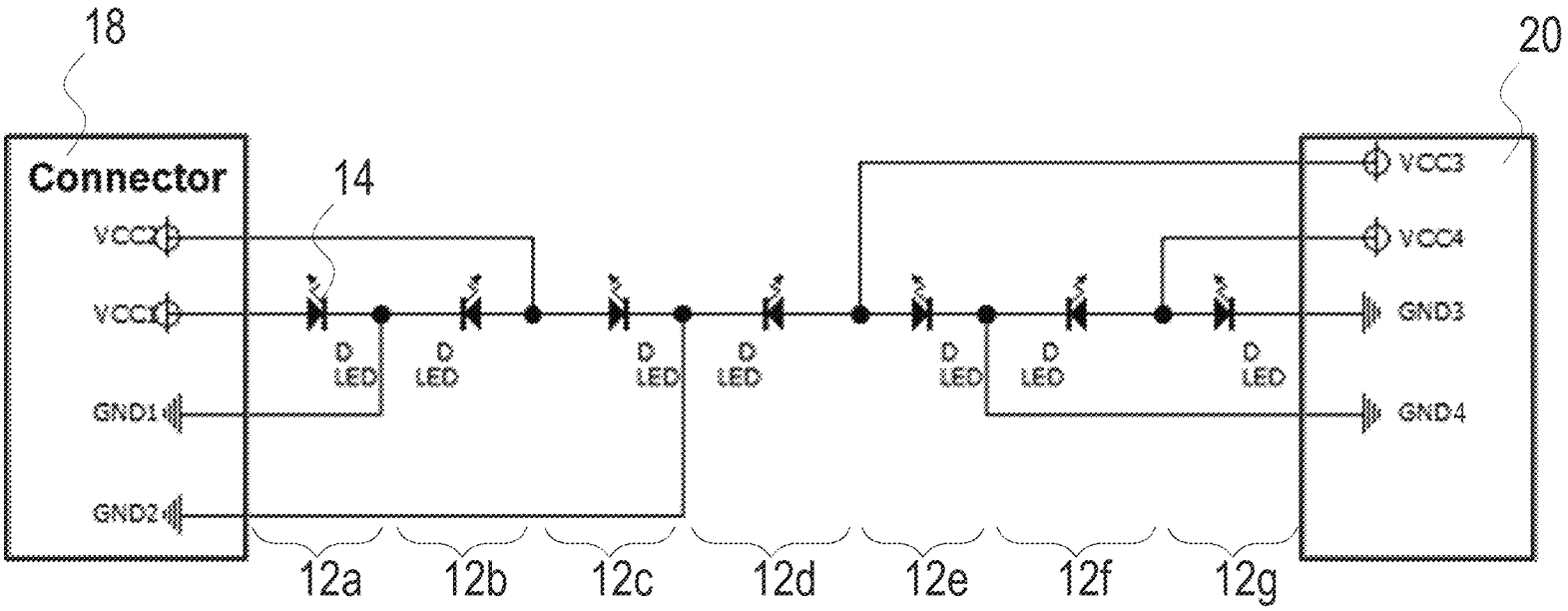
FIG. 3 is a circuit diagram of another embodiment of the present invention.

FIG. 3 shows another example of a circuit diagram of the present invention. Each segment 12 consists of only a single LED 14, wherein seven segments 12 are present in FIG. 3. However, each segment 12 may also comprise more than one LED 14. Further, it is possible to provide a smaller number of segments 12.

The first connector 18 comprises a first ground pin, as well as a second ground pin and a first anode pin, as well as a second anode pin. The second connector 20 comprises a third ground pin and a fourth ground pin, as well a third anode pin and a fourth anode pin. Further, the first connector 18 controls a first group of segments including 12*a*, 12*b* and 12*c* and the second connector 20 controls a second group of segments including 12*d*, 12*e* and 12*f* and 12*g*. The first connector 18 and the second connector 20 are connected to the lighting elements 10 of the lighting device by four wires which are arranged in parallel along the entire length of the lighting device. Thus, by the pins of the first connector 18 and the second connector 20 connecting the lighting device to a lighting driver, each segment 12 can be controlled individually in order to provide dynamical lighting.

Figure 4:
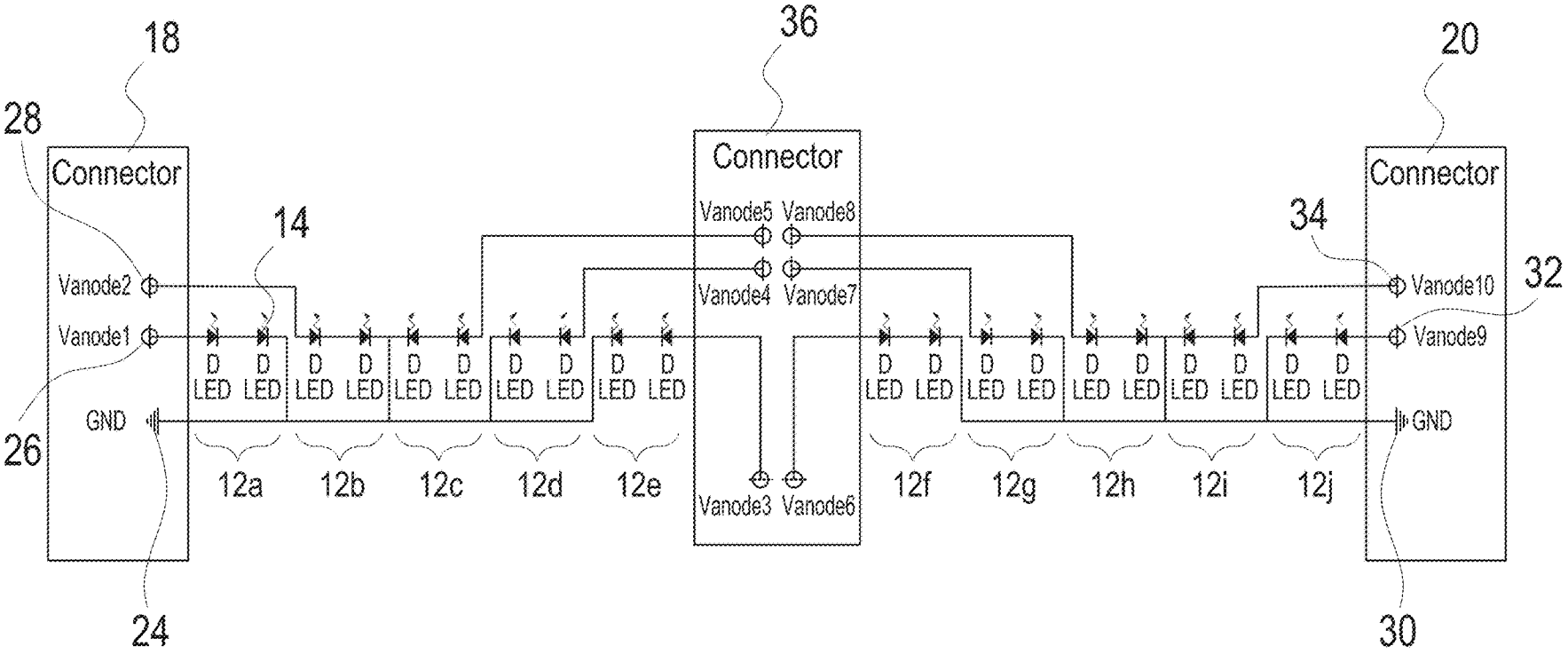
FIG. 4 is a circuit diagram of another embodiment of the present invention.

FIG. 4 shows another embodiment of the present invention, wherein each segment 12 is exemplified to have two LEDs 14 which can be disposed on different lighting elements 10 or the same lighting element 10. However, further LEDs 14 and/or further lighting elements 10 can be introduced in each segment 12.

The lighting device of FIG. 4 shows a first connector which is identical to the connector of FIG. 2. Further, the lighting device comprises a second connector 20 which is identical to the second connector 20 of FIG. 2 except that the pin 30 as shown in FIG. 4 is a ground pin. Thus, also in the embodiment of FIG. 4, three parallel wires are foreseen along the lighting device. However, additionally a third connector 36 is disposed between the first connector 18 and the second connector 20. In particular, the third connector 36 is disposed between the fifth segment 12*e* and the sixth segment 12*f*, counting from the leftmost segment, of the lighting device. The third connector 36 has six anode pins which are arranged in two columns and is to be connected to the lighting driver to control individually the segments 12 of LEDs 14 in order to achieve dynamical lighting. As illustrated in FIG. 4, the first connector 18 controls a first group of segments including 12*a* and 12*b*; the second connector 20 controls a second group of segments including 12*i* and 12*j*; and the third connector 36 controls a third group of segments including 12*c*, 12*d*, 12*e*, 12*f*, 12*g* and 12*h*.

Figures 1, 5:
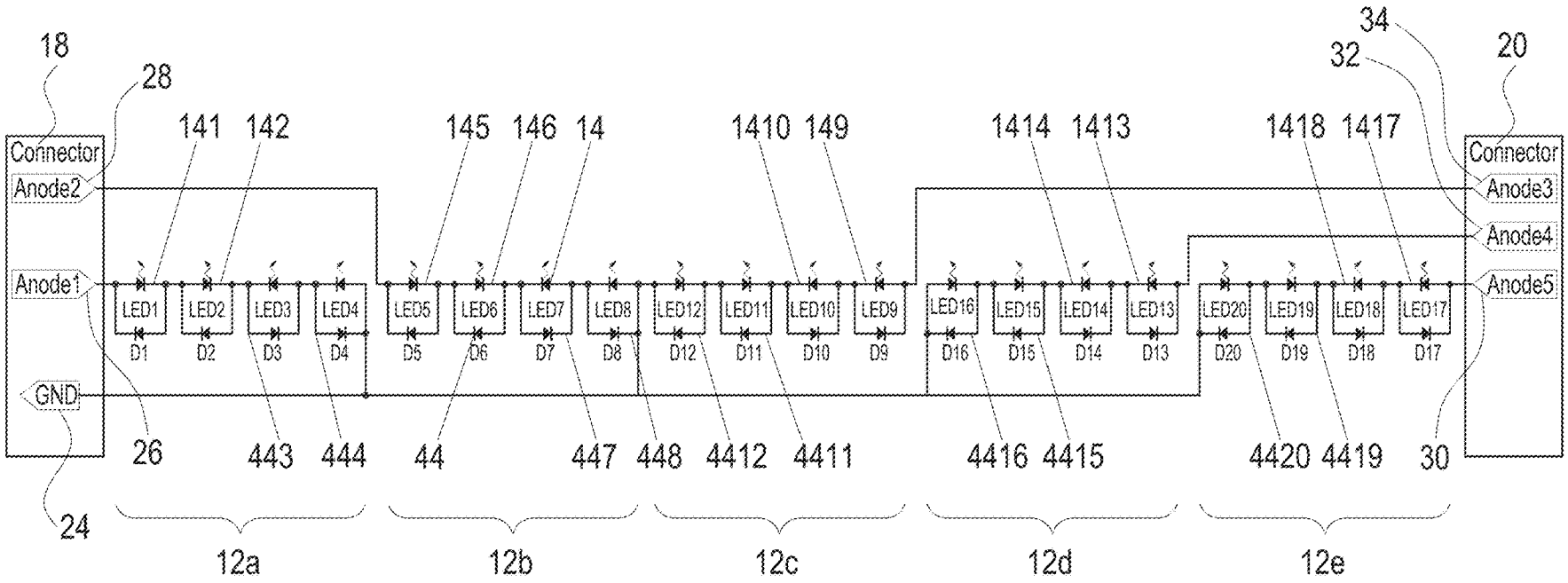
Figures 2, 5:
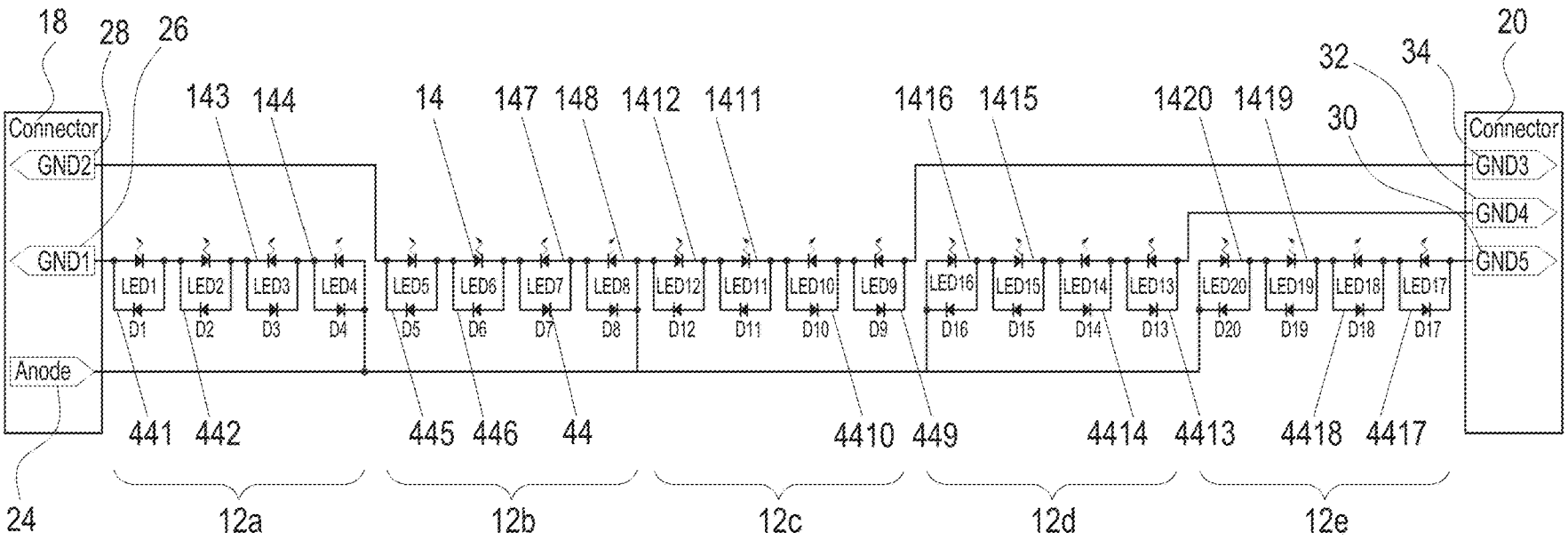

FIG. 5-1 shows another example of a circuit diagram of the present invention, which includes an identical first connector 18 as well as an identical second connector 20 as the example illustrated in FIG. 2. Each segment 12 comprises four LEDs 14 which are further evenly divided into two sub-segments. It is however not necessary that each sub-segment within the same segment comprises the same number of lighting elements. In accordance to FIG. 5-1, two sub-segments within any segment are electrically connected anti series to each other such that the two sub-segments cannot be switched on at the same time. Further, each LED 14 is electrically connected to a rectifier diode 44 anti parallel. The first connector 18 provides current for a first group of segments including segments 12*a* and 12*b*, wherein two anode pins 26 and 28 of the first connector 18 are arranged at the two upper positions in the column of pins and one ground pin 24 is arranged at the lowermost position in the column of pins. As a result, LEDs 141 and 142 comprised in segment 12*a* and LEDs 145 and 146 comprised in segment 12*b*, which are half of the LEDs comprised in the first group of segments, are switched on whereas the respective currents bypass the rest of LEDs through rectifier diodes 443 and 444 comprised in segment 12*a* and rectifier diodes 447 and 448 comprised in segment 12*b*. The second connector 20 provides current for a second group of segments including segment 12*c*, 12*d* and 12*e*, wherein three anode pins 30, 32 and 34 are provided in the column of pins. Consequently, LEDs 149 and 1410 comprised in segment 12*c*, LEDs 1413 and 1414 comprised in segment 12*d*, and LEDs 1417 and 1418 comprised in segment 12*e*, which are half of the LEDs comprised in the second group, are switched on whereas the respective currents bypass the rest of LEDs through rectifier diodes 4411 and 4412 comprised in segment 12*c*, rectifier diodes 4415 and 4416 comprised in segment 12*d* and rectifier diodes 4419 and 4420 comprised in segment 12*e*. Therefore, by arranging the power supplied to the lighting elements in such a way as mentioned above, it is possible to further increase the resolution of the lighting and dimming without adding any more complex circuitry. In the specific case as depicted in FIG. 5-1, the resolution is twice of that as described in FIG. 2 since only half of the LEDs are switched on at a given moment.

FIG. 5-2 shows the counterpart of the example illustrated in FIG. 5-1, which swaps the anode pins with the ground pins. As a result, all LEDs which are switched on in FIG. 5-1 are in the present case bypassed by the rectifier diodes 441, 442, 445, 446, 449, 4410, 4413, 4414, 4417 and 4418 connected to them; and all the LEDs which are not switched on in FIG. 5-1, namely LEDs 143, 144, 147, 148, 1411, 1412, 1415, 1416, 1419, and 1420, are now switched on. Since each segment may comprise different number of lighting elements and each group may comprise different number of segments, flexible control of lighting patters is possible. Further, as exemplified by FIGS. 2 to 4, the lighting device in accordance to FIGS. 5-1 and 5-2 may also comprise one connector only or three connectors and may also comprise a different arrangement of the power-supply pins from the specific ones shown in FIGS. 5-1 and 5-2. For instance, both embodiments illustrated in FIGS. 3 and 4 can be modified to obtain double resolution of lighting and dimming in the same way as the example of FIG. 2 is modified to that of FIGS. 5-1 and 5-2.

Figure 6:
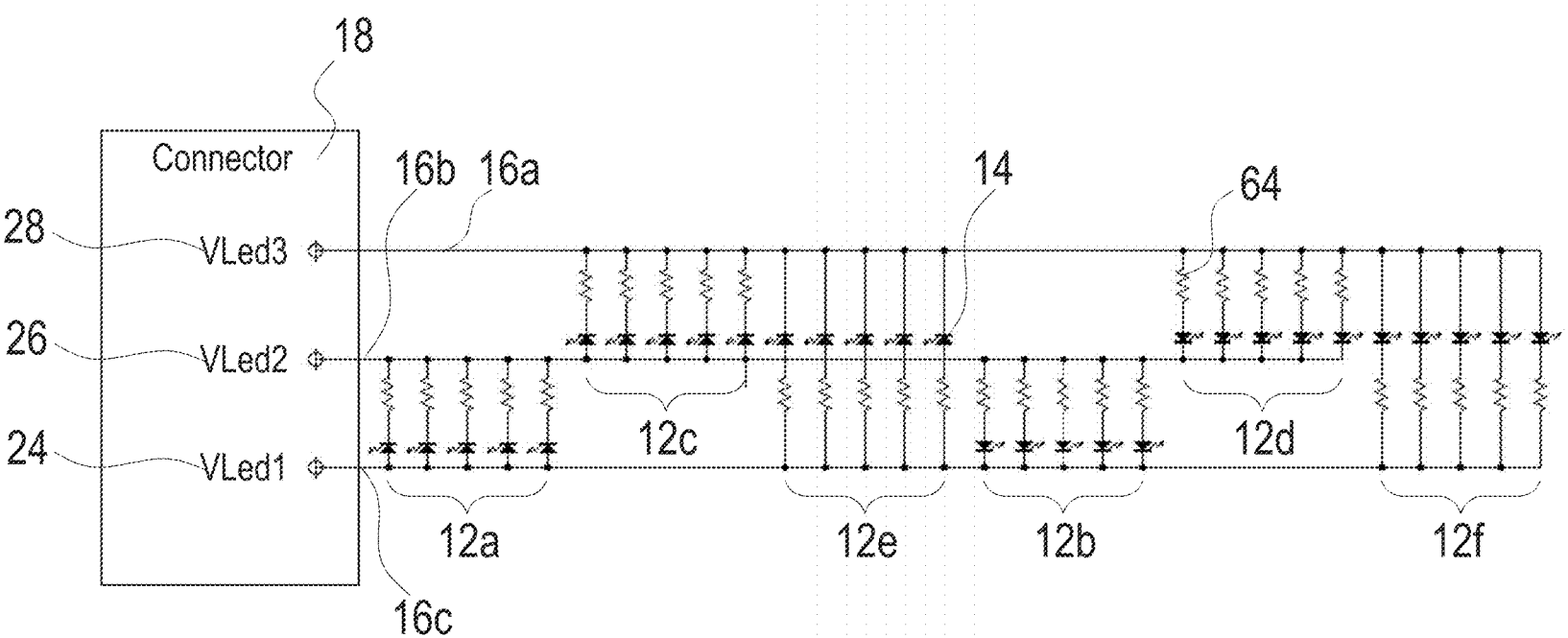
FIG. 6 is a circuit diagram of another embodiment of the present invention.

FIG. 6 shows another example of a circuit diagram of the present invention which comprises a first connector 18, wherein three electrical wires stem from the three power-supply pins, namely a first pin 24, a second pin 26 and a third pin 28, comprised in the first connector 18. Across any two pins, there are two segments of LEDs connected therebetween and anti parallel to each other. Within each segment, there are 5 LEDs connected therebetween across the respective pins and in parallel to each other. Each segment may comprise the same or different number of lighting elements and each lighting element may of course comprise one or more LEDs. Across pins 24 and 26, segments 12*a* and 12*b* are connected anti parallel through wires 16*b* and 16*c* and are preferably arranged in the same row; across pins 26 and 28, segments 12*c* and 12*d* are connected anti parallel through wires 16*a* and 16*b* and are preferably arranged in the same row; and across pins 28 and 24, segments 12*e* and 12*f* are connected anti parallel through wires 16*b* and 16*c* and are preferably arranged in the same row. It is possible to realize different patterns of lighting and dimming with selected wire routings, since segments connected between any pair of pins may also be arranged at different rows of lighting elements and may even be arranged in not necessarily the same surface of the lighting device due to electrical wires that can be bended in two axes as described above.

In the example of FIG. 6, the voltages supplied at pins 24, 26 and 28 can be of a decreasing order; in other words, the voltage at pin 24 is higher than that at pin 26 and the voltage at pin 26 higher than pin 28 as well. In this way, it is ensured that currents flow through only segments 12*a*, 12*c* and 12*e*. Such power supply can be provided by an active B6 bridge. Each LED 14 is further connected in series to one current limiter 64. Consequently, only segments 12*a*, 12*c* and 12*e* can be switched on given the above-mentioned power supply arrangement. Further increment of resolution within segments of lighting elements is thus possible simply by changing the voltage supplies at the connector. In this specific case, the resolution is doubled. Furthermore, by altering the number of lighting elements comprised in each segment and the number of segments along the entire luminous band, it is possible to obtain other ratios of increment of the resolution as well as complex lighting patterns.

In the example of FIG. 6, the voltages supplied at pins 24, 26 and 28 can also be of, for instance, an increasing order; in other words, the voltage at pin 24 is lower than that at pin 26 and the voltage at pin 26 lower than pin 28 as well. In this way, it is ensured that currents flow through only segments 12*b*, 12*d* and 12*f*. Thus, different ways of physically arranging the segments along or over the two rows of lighting elements make possible versatile lighting patterns.

Figure 7:
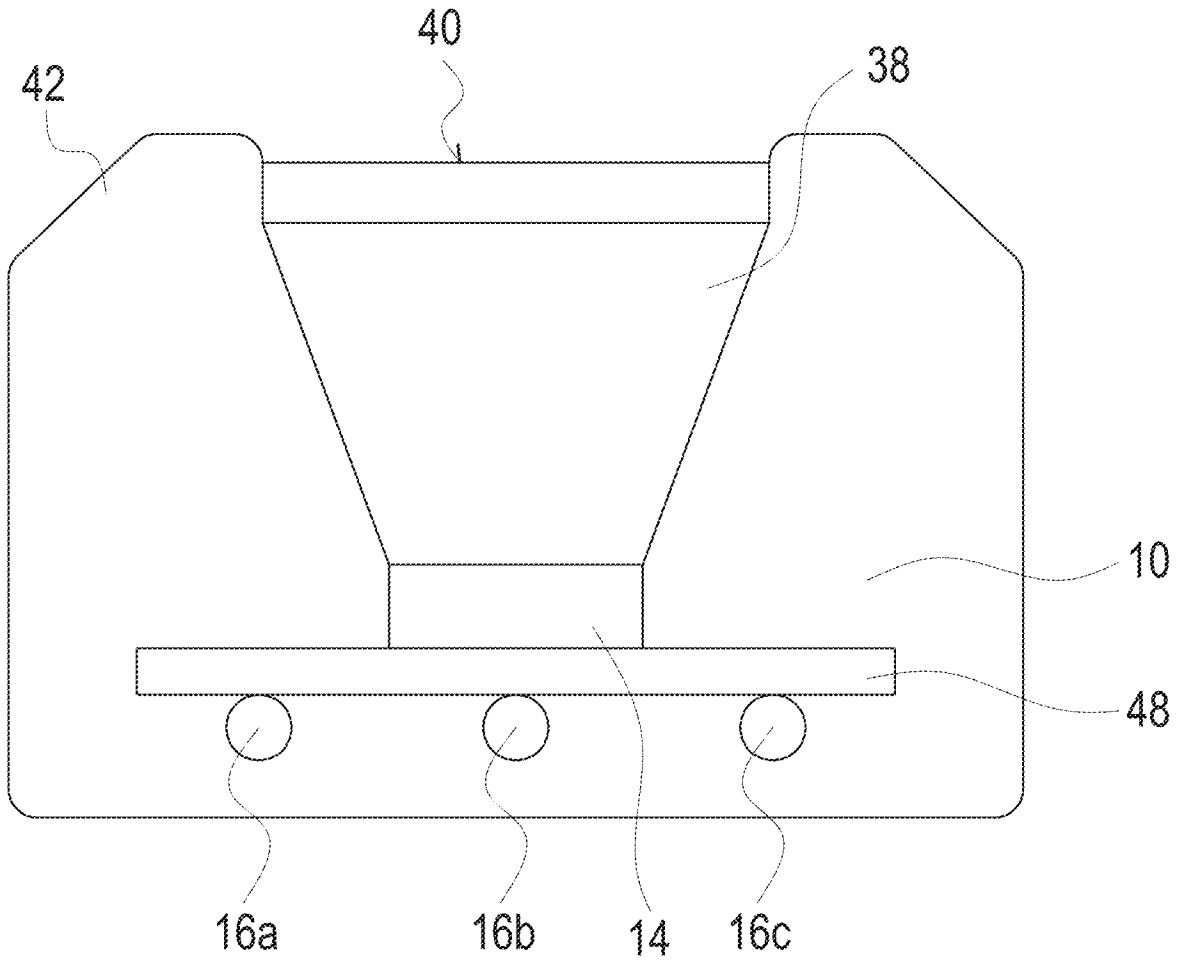
FIG. 7 is a cross-section of the lighting device.

FIG. 7 shows a cross-section of the lighting device. An LED 14 is disposed on the top of an interposer or lighting element 10. The lighting element 10 is connected by three wires 16*a*, 16*b*, 16*c* in the example of FIG. 5. The light emitting side of the LED 14 is connected by a transparent polymer 38 to a light emitting surface 40 of the lighting device. The wires 16*a*, 16*b*, 16*c*, the lighting element 10, the LED 14 and the transparent polymer 38 is surrounded by an opaque polymer 42. The opaque polymer 42 serves as protection cover for the lighting device while still providing sufficient flexibility. Additionally, the opaque polymer 42 might be white polymer that is reflecting any light emerging from the transparent polymer 38 back towards the light emitting surface 40 thereby increasing the efficiency of the lighting device. Of course, the opaque polymer 42 can have alternatively any other color being adapted to the specific application.

Figure 8:
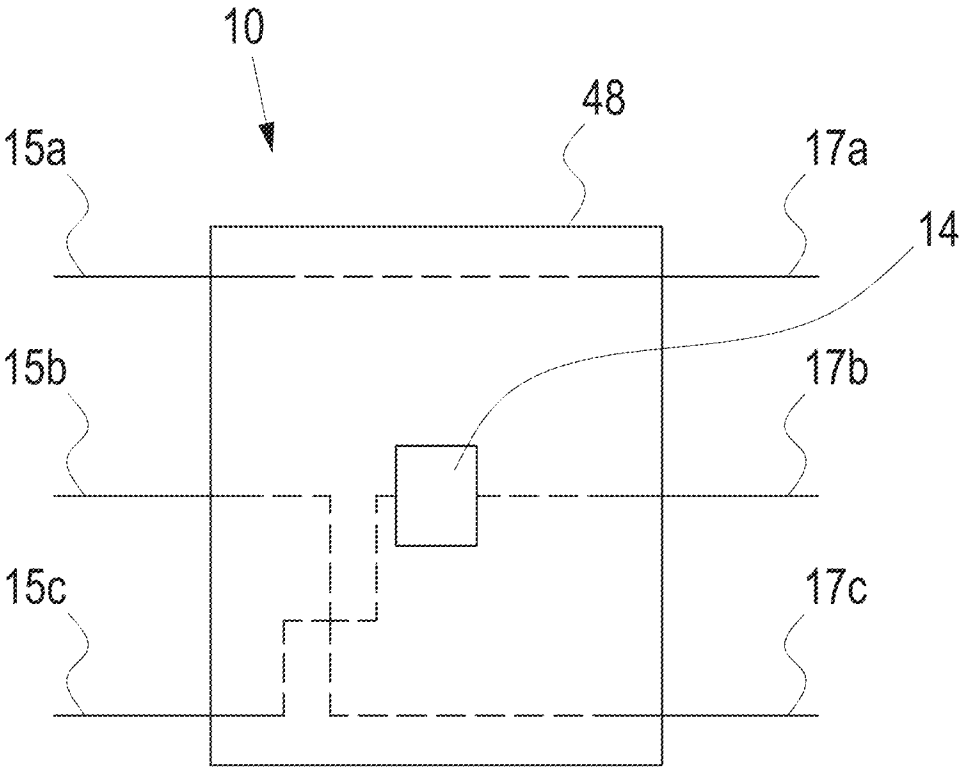
FIG. 8 is a detailed view of a lighting element.

FIG. 8 shows a detailed view of an interposer or lighting element 10. The lighting element 10 comprises a printed circuit board (PCB) 48 with an LED 14 arranged on one upper side of the PCB 48. The PCB 48 is connected to a preceding lighting element 10 or contacting element in the row by a first set of three wires 15*a*, 15*b* and 15*c*, wherein the three wires are placed in parallel and connected to the PCB 48 at a first position (upper position in FIG. 6), a second position (middle position in FIG. 6) and a third position (lower position in FIG. 6), respectively. However, in other embodiments more or fewer wires can be implemented. In addition, the lighting element 10 is connected to a following lighting element 10 or contacting element by a second set of three wires 17*a*, 17*b* and 17*c* which are placed also in parallel and connected to the PCB 48 on the opposite side to the first set, wherein the wires are also connected to the PCB 48 at positions corresponding to the first position, the second position, and the third position. Therein, dashed lines in FIG. 6 indicate electrical routings provided by the PCB 48 of the lighting element 10. In the example of FIG. 6 a first anode connection 15*a*, 17*a* is running through the PCB 48, wherein the first anode connection 15*a*, 17*a* is on both sides of the PCB 48 connected at the first position to the PCB 48. However, a second anode connection 15*b*, 17*c* might be connected at different positions at the two sides of the PCB 48. Further, a ground connection 15*c* might be connected at one position to the PCB on a first side and then connected by the circuitry of the PCB 48 to the LED. An anode connection 17*b* might be connected to the PCB 48 at the same side or the opposite side at the same or different position to the ground connection 15*c* and then connected to the LED 14. Thus, the LED 14 is connected to an anode connection 17*b* by the circuitry of the PCB 48 and also to the ground connection 15*c* in order to supply power to the LED 14. Thus, by the PCB 48 of the lighting elements 10 a more complex wire routing can be implemented such as crossing electrical lines to be able to maintain parallel wires between each of the lighting elements. Thereby, a high degree of freedom regarding the wire routing along the lighting device is provided.

Figure 9:
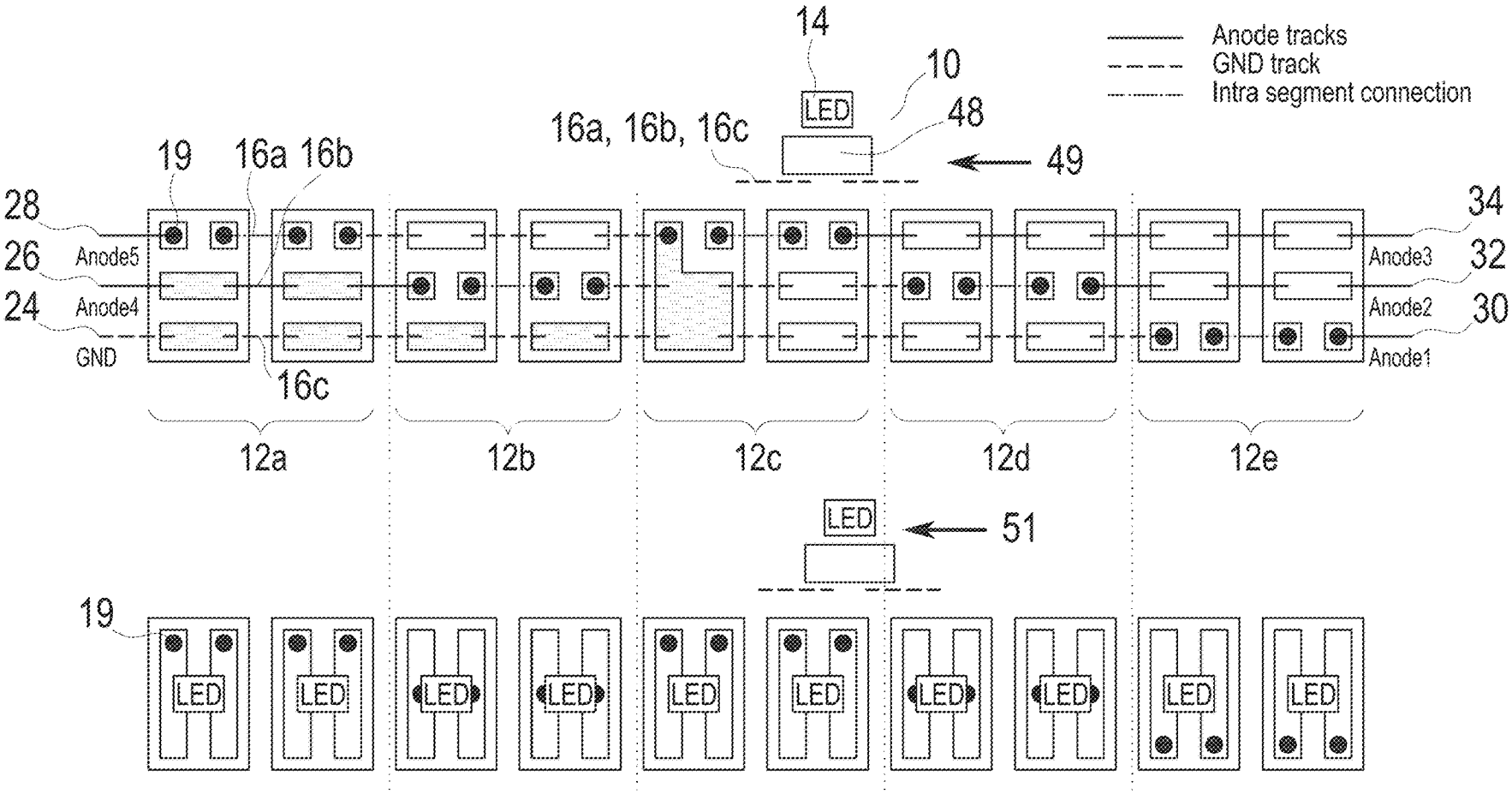
FIG. 9 is a contacting scheme of the lighting device.

FIG. 9 shows a detailed view of the lighting device by illustrating the connections between interposers or lighting elements 10 when being viewed from top of the lighting device, wherein the upper portion of FIG. 9 shows a top view on a bottom level of the lighting elements (as the left-pointing arrow 49 suggests) and the lower portion of FIG. 9 shows a top view on a top level of the lighting elements (as the left-pointing arrow 51 suggests). In FIG. 9, each lighting element 10 comprises one LED 14 sitting on top of the PCB 48 under which a set of wires 16*a*, 16*b* and 16*c* are used to provide power to the LED 14, which is in correspondence with the examples of FIG. 7 and FIG. 8. Moreover, in the example of FIG. 9, electrical connections with positive voltage or connected to anode leadframes are represented by solid lines and denoted as anode tracks; electrical connections of GND are represented by dashed lines and denoted as GND tracks; and the intra segment connections which connect consecutive LEDs comprised within one segment are represented by dash-dot lines.

As illustrated in the upper portion of FIG. 9, a luminous band is formed comprising ten lighting elements 10 which are evenly divided into five segments 12*a*, 12*b*, 12*c*, 12*d* and 12*e*. On the leftmost side of the luminous band, two anode pins 28 and 26 and one GND pin 24 are arranged; and on the rightmost side of the luminous band, three anode pins 34, 32 and 30 are arranged. Within each segment, there are two LEDs 14 connected to each other by intra segment connection. Two soldering points 19 are accordingly provided for each LED 14 in the corresponding lighting element in order to connect the respective LED 14 to anode or GND pins as well as to LEDs 14 comprised in other lighting elements. Take segment 12*a* as an example, the two LEDs therein are connected to each other via intra segment connection whereas the left side of segment 12*a* is connected to pin 28 supplying high or positive voltage and on the right side of segment 12*a*, GND track or connection is provided such that the two LEDs in segment 12*a* are switched on. Take segment 12*b* as another example, the anode track starting from pin 26 goes through the shaded areas illustrated in segment 12*a* until reaching the soldering point 19 at the left side of the segment 12*b* such that the two LEDs in segment 12*b* are switched on. As further illustrated in the lower portion of FIG. 9, soldering points 19 comprised in the segments are arranged as being staggered segment by segment such that each segment can be independently controlled by the corresponding pins. More specifically, segment 12*a* is electrically connected between anode pin 28 and GND pin 24, segment 12*b* between anode pin 26 and GND pin 24, segment 12*c* between anode pin 34 and GND pin 24, segment 12*d* between anode pin 32 and GND pin 24, and segment 12*e* between anode pin 30 and GND pin 24.

What is claimed is:

1. A lighting device comprising:

a luminous band comprising:

a row of lighting elements divided into a plurality of segments of at least two lighting elements, each of the lighting elements comprising at least one light emitting diode, and the at least two lighting elements within each segment being electrically connected in series, a first terminal connector at a first end of the row of lighting elements, the first terminal connector configured to provide a current for a first group of the plurality of segments, and a plurality of wires electrically coupled between the first terminal connector and the first group of the plurality of segments and between each of the lighting elements in the row.

2. The lighting device of claim 1, wherein the first terminal connector comprises a plurality of power-supply pins comprising at least one voltage supplying pin and at least one ground pin.

3. The lighting device of claim 1, further comprising:

a second terminal connector at a second end of the row of lighting elements, the second terminal connector configured to provide a current for at least a second group of the plurality of segments.

4. The lighting device of claim 3, further comprising a second plurality of wires electrically coupled between the second terminal connector and the second group of the plurality of segments.

5. The lighting device of claim 3, wherein the second terminal connector further comprises an integer number of second power-supply pins equal to an integer number of the plurality of power supply pins of the first terminal connector.

6. The lighting device of claim 3, further comprising at least one third terminal connector between the first terminal connector and the second terminal connector along the row of lighting elements, the at least one third terminal connector configured to provide a current for at least one third group of the plurality of segments.

7. The lighting device of claim 6, further comprising a third plurality of wires electrically coupled between the third terminal connector and the at least one third group of the plurality of segments.

8. The lighting device of claim 6, wherein each of the at least one third terminal connector comprises a plurality of third power-supply pins arranged in two sets, an integer number of the plurality of third power-supply pins in each of the two sets being the same as at least one of an integer number of power-supply pins of the first terminal connector or the second terminal connector.

9. The lighting device of any of claim 7, wherein the plurality of wires, the second plurality of wires and the third plurality of wires comprise a plurality of bendable electrical wires running through the row of lighting elements and arranged substantially parallel to each other.

10. The lighting device of claim 9, wherein the plurality of bendable electrical wires are at least one of flexible in two bending axes or twistable along a longitudinal axis of the lighting device, wherein the two bending axes are at least one of perpendicular to each other or perpendicular to the longitudinal axis.

11. The lighting device of 9, wherein an integer number of the bendable electrical wires is the same as an integer number of power-supply pins of at least one of the first terminal connector, the second terminal connector or the at least one third terminal connector.

12. The lighting device of claim 11, wherein the integer number of bendable electrical wires is 3 or 4.

13. The lighting device of claim 1, wherein at least two of the plurality of segments comprise the same number of lighting elements.

14. A lighting device comprising:

a luminous band comprising:

at least two parallel rows of lighting elements divided into a plurality of segments, each of the lighting elements comprising at least one light emitting diode, and the lighting elements within each of the plurality of segments being electrically connected in parallel, a first terminal connector at one end of the at least two parallel rows of lighting elements, the first terminal connector comprising at least three power-supply pins configured to provide a current for the lighting elements, and a plurality of wires electrically coupled between the first terminal connector and the plurality of segments.

15. The lighting device of claim 14, wherein at least two of the plurality of segments of lighting elements are electrically coupled anti parallel to each other across any two of the at least three power-supply pins.

16. The lighting device of claim 14, wherein the at least three power-supply pins are arranged in one column and are configured to supply voltages having different values.

17. The lighting device of claim 14, further comprising a current limiter, each of the lighting elements being electrically coupled to the current limiter in series.

18. The lighting device of claim 14, wherein a power provided through the at least three power-supply pins is provided by an active B6 bridge.

19. The lighting device of claim 14, wherein the plurality of wires comprise a plurality of bendable electrical wires running through the at least two parallel rows of lighting elements.

20. The lighting device of claim 19, wherein the plurality of bendable electrical wires are at least one of flexible in two bending axes or twistable along a longitudinal axis of the lighting device, the two bending axes being at least one of perpendicular to each other or perpendicular to the longitudinal axis.

21. The lighting device of claim 19, wherein the plurality of bendable electrical wires comprise three bendable electrical wires.

22. A lighting device comprising:

a luminous band comprising:

a row of lighting elements divided into a plurality of segments of at least two lighting elements, each of the lighting elements comprising at least one light emitting diode and each of the plurality of segments being further divided into at least two sub-segments, wherein, within each segment, any two consecutive sub-segments are electrically coupled anti series to each other, a first terminal connector at a first end of the row of lighting elements, the first terminal connector configured to provide a current for a first group of the plurality of segments, and a plurality of wires electrically coupled between the first terminal connector and the first group of the plurality of segments and between each of the lighting elements in the row.

23. The lighting device of claim 22, further comprising a plurality of rectifier diodes, each electrically coupled anti parallel to a respective light emitting diode.

* * * * *